US008180230B2

(12) United States Patent
Klassen

(10) Patent No.: US 8,180,230 B2
(45) Date of Patent: May 15, 2012

(54) TONER CONSUMPTION CALCULATION FOR PRINTER WITH MULTIPLE INTERACTING SEPARATIONS

(75) Inventor: R. Victor Klassen, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 741 days.

(21) Appl. No.: 12/332,657

(22) Filed: Dec. 11, 2008

(65) Prior Publication Data

US 2010/0150582 A1 Jun. 17, 2010

(51) Int. Cl.
*G03G 15/08* (2006.01)

(52) U.S. Cl. ..... 399/27

(58) Field of Classification Search ..... 399/27, 399/28, 79

See application file for complete search history.

(56) References Cited

U.S. PATENT DOCUMENTS 5,204,699 A 4/1993 Birnbaum et al.
5,305,119 A * 4/1994 Rolleston et al. ..... 358/522
5,383,129 A 1/1995 Farrell
5,894,358 A * 4/1999 Ebner et al. ..... 358/529
6,356,359 B1 3/2002 Motamed
7,190,487 B2 * 3/2007 Dalrymple et al. ..... 358/1.9
7,359,088 B2 4/2008 Clark et al.
2004/0227977 A1 * 11/2004 Yoshida ..... 358/3.01
2007/0030500 A1 * 2/2007 Otake et al. ..... 358/1.9
2008/0075480 A1 3/2008 Konishi et al.

* cited by examiner

*Primary Examiner* — David Gray
*Assistant Examiner* — Rodney Bonnette
(74) *Attorney, Agent, or Firm* — Fay Sharpe LLP

(57) ABSTRACT

Systems and methods are described that facilitate calculating toner consumption by a printing device. A multi-dimensional transform is applied to electronic image data to map or correlate toner consumed in a non-interacting color separation to toner consumed in an interacting color separation, for each of a plurality interacting color separations (e.g., C, M, Y, and/or K). Optionally, a one-dimensional linearization technique is performed on the image data before and/or after transformation. Image data resolution may be reduced to generate continuous-tone image data. A summed or average toner consumption value is output for each or all separations for user review.

21 Claims, 2 Drawing Sheets

TONER CONSUMPTION CALCULATION FOR PRINTER WITH MULTIPLE INTERACTING SEPARATIONS

BACKGROUND

The subject application relates to toner consumption calculation and/or calibration for a printing device that employs multiple interacting color separations. While the systems and methods described herein relate toner calibration, it will be appreciated that the described techniques may find application in other resource cost estimation systems, other xerographic applications, and/or other printing systems.

Classical methods of calculating the amount of toner consumed in an electro-photographic system generally involve some form of calculating the area coverage of each region of the page, and applying a Tone Reproduction Curve (TRC) metric to convert from digital coverage to toner and/or cost. (A TRC is often implemented as a one dimensional lookup table, but it could also be implemented as a functional form). They operate in a separation-independent manner. On many print engines, in which the amount of toner a given separation consumes depends on the amount of toner previously present for prior separations, separation-independent calculations give inaccurate results.

One such technique converts from bit coverage to material consumption in the single separation case. Another addresses using computed materials and converting to costs and/or prices. Yet another uses a reduced resolution image. Several others address using a subset of the pixels to compute the coverage statistically. Another addresses printing and scanning, and then estimating the coverage from the scan, as well as simply calculating the coverage from the bitmap and printing the calculated result on the document. Another technique uses a model of halftone dot growth to predict toner consumption.

For example, U.S. Pat. No. 5,204,699 addresses converting from bit coverage to material consumption in the single separation case. U.S. Pat. No. 5,383,129 addresses taking computed materials and converting to costs and/or prices. U.S. Pat. No. 6,356,359 addresses using a reduced resolution image. U.S. Pat. Nos. 5,604,578 and 5,592,298 relate to taking a subset of image pixels to compute the coverage statistically. U.S. Pat. No. 7,359,088 relates to printing, scanning, and estimating the coverage from the scan, calculating the coverage from the bitmap, and printing the calculated result on the document. US Application 2008/0075480 A1 addresses a model of halftone dot growth to predict toner consumption. However, all of these techniques are susceptible to inaccuracies when dealing with interacting color separations.

Accordingly, there is an unmet need for systems and/or methods that facilitate calculating toner consumption for a printer that uses interacting color separations, while overcoming the aforementioned deficiencies.

BRIEF DESCRIPTION

In accordance with various aspects described herein, systems and methods are described that facilitate calculating toner consumption in a printing engine that employs interacting color separations. For example, a method of calculating toner consumption by a printer comprises receiving image data describing a plurality of interacting color separations in an electronic image, and executing a multi-dimensional transformation on the image data to correlate toner consumed in a non-interacting separation to toner consumed in an interacting separation, for each of the interacting color separations. The method further comprises outputting a toner consumption value for each of the plurality of interacting color separations. Optionally, a resolution of a received image may be reduced to generate continuous tone image data prior to transformation.

According to another feature described herein, a toner consumption calculation system for a printer comprises a memory that stores computer-executable instructions for performing a multi-dimensional transformation on the image data to correlate toner consumed in a non-interacting separation to toner consumed in an interacting separation, for each of the interacting color separations, and outputting a toner consumption value for each of the plurality of interacting color separations. The system further comprises a processor that executes the instructions. The image data describes a plurality of interacting color separations in an electronic image.

Yet another feature relates to an apparatus for calculating toner consumption in a printer that comprises means for receiving image data describing a plurality of interacting color separations in an electronic image, means for reducing the resolution of the received image data to generate continuous tone image data, and means for performing a first one-dimensional linearization to linearize the continuous tone image data. The apparatus further comprises means for performing a multi-dimensional transformation on the linearized image data using a lookup table to correlate toner consumed in a non-interacting separation to toner consumed in an interacting separation, for each of the interacting color separations, and means for performing a second one-dimensional linearization on transformed image data after performing the multi-dimensional transformation. The apparatus additionally comprises means for outputting an average toner consumption value for the plurality of interacting color separations. The multi-dimensional transform has a number of dimensions equal to the number of interacting color separations. The plurality of interacting color separations includes one or more of a cyan (C) color separation, a magenta (M) color separation, a yellow (Y) color separation, and a key (K) color separation.

DETAILED DESCRIPTION

In accordance with various features described herein, systems and methods are described that facilitate calibrating toner usage for a printing device. The described systems and methods facilitate applying an N-dimensional mapping, on a per-pixel basis (optionally at reduced resolution), from requested coverage to consumed toner quantity. The mapping may be implemented as a combination of tone reproduction curves (TRCs) with multidimensional interpolated lookup tables (LUTs), although other forms of multidimensional mapping may be used in accordance with various aspects. The resulting toner consumption information can be reported to a customer or used in feed-forward control of such parameters as toner dispense.

Figure 1:
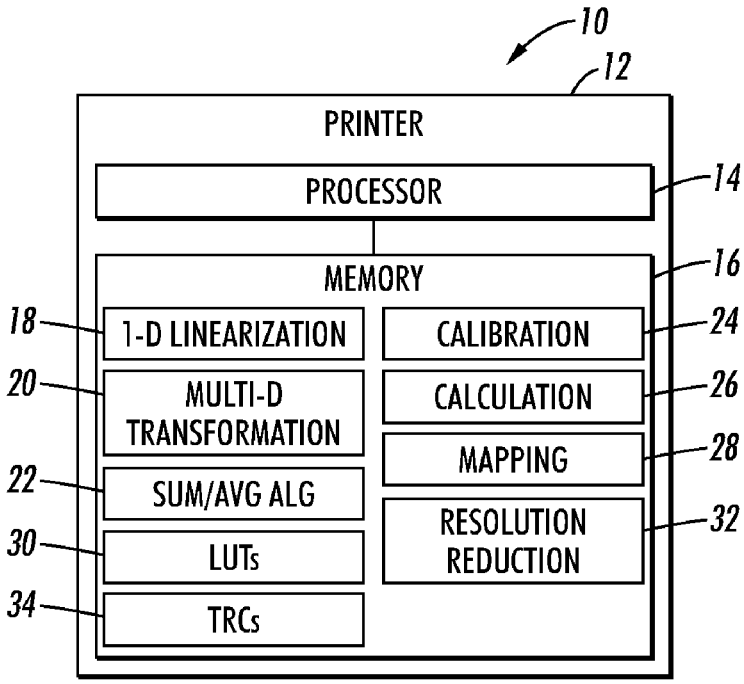
FIG. 1 illustrates a toner consumption calculation system that facilitates calculating an amount of toner consumed by a printing device when multiple interacting separations are employed.

With reference to FIG. 1, a toner consumption calculation system 10 is illustrated that facilitates calculating an amount of toner consumed by a printing device when multiple interacting separations are employed. "Separation," as used herein, refers to a color separation (e.g., cyan, magenta, yellow, black, etc.) typically employed in color printing systems and methods. The system includes a printer 12 with a processor 14 that executes computer-executable instructions and/or algorithms stored in a memory 16. The memory stores, and the processor executes, a one-dimensional (1-D) linearization algorithm 18 on continuous tone image data, that maps requested coverage information to consumed toner information for single separations printed individually. The processor further executes a multi-dimensional (e.g., one dimension for each separation in the image) transformation algorithm 20 that maps toner consumed in a non-interacting system to toner consumed in an interacting system. The processor then optionally executes another 1-D linearization algorithm on the information resulting from the multi-dimensional transformation algorithm to account for toner that is not transferred to the page. A summing and/or averaging algorithm 22 is executed by the processor to sum and/or average the values produced by the second 1-D linearization (if executed) and/or the multi-dimensional transformation, and the calculated toner consumption information is then output and/or stored to memory for review by an operator or use by a process control subsystem.

In another embodiment, the processor executes an overall calibration algorithm 24 that calibrates the printer 12, in which a known coverage (e.g., 50%) is printed over a long series of prints. The processor then executes a calculation algorithm 26 to calculate an amount of toner used per page in the known coverage print, and an amount of toner consumed on a nominal page (e.g., 5% coverage), to generate a coverage adjustment factor. The calculation algorithm 26 additionally computes input and output TRC values. The input TRC maps requested coverage to toner weight on paper, and the output TRC maps toner weight on paper to toner consumed. The processor then executes a mapping algorithm 28 that maps toner weight for single separation colors to toner weight for multiple separation colors. The processor then calculates toner consumption for the multiple interacting separations.

The memory 16 additionally stores multi-dimensional lookup tables (LUTs) 30 that are accessed during execution of the multi-dimensional transformation algorithm. Additionally, the memory stores, and the processor executes, a resolution reduction algorithm 32 that generates a reduced-resolution representation of the coverage, in all separations, of blocks or regions on a page, in order to facilitate execution of the various algorithms described herein. Finally, the memory 16 stores one or more TRCs 34 that describe the total resource costs associated with toner consumption for corresponding to one or more print jobs.

In an alternative embodiment, the multi-dimensional lookup tables may be replaced by coefficients of a multidimensional function, such as a polynomial.

According to an example, in a digital front end (DFE) of the printer 12, for a digital printing workflow, such as a XEROX™ continuous tone FreeFlow™ DocuSP™ system, an optional XM2 (or the like) thumbnail may be generated for a page of a document. Such a thumbnail may be a $1/8^{th}$ resolution version of the page, where each pixel represents the average of a corresponding 8×8 block of pixels in the original page. In a binary system, such a thumbnail is not available. However, the average of eight consecutive pixels along a scanline (e.g., by table lookup of an LUT stored in the memory 16, counting the number of 1s in a byte to yield the coverage value) is quickly computable, and the sixty-four pixels in eight successive scanlines can be averaged by the processor 14 by executing seven adds and a shift. Thus, the system 10 provides a reduced resolution representation of the coverage, in all color separations, of blocks in the page. A reduction by a factor of 8 is not required, but is used herein for purposes of illustration.

In another example, the print platform employed in the printer 12 is a XEROX iGen™ platform (e.g., a digital color production press that can print near-offset quality prints in small or large runs), in which the amount of toner consumed for each separation in a local area depends both on the amount of digital coverage in that area, and the amount of toner laid down on the photoreceptor for each prior separation imaged. The amount of toner laid down for each prior separation imaged depends both on the amount of digital coverage for that separation and the amount laid down for any separation preceding the prior separation, and so on, such that the amount of toner used for a given separation is a function of the amount of digital coverage for the given separation and the amount of toner used for any separation preceding the given separation. Furthermore, on a job of any significant length (e.g., greater than approximately 50 pages, or some other suitable threshold number), low-area coverage requests for any given separation result in auto-toner purge, increasing the amount of toner consumed over the amount of toner requested.

Depending on the final application, the amount of toner that is transferred to the page may be of significance, or the amount that is dispensed may be of significance, or a combination thereof. If the information is being passed on to a fusing subsystem, for example, then the transferred amount is relevant. For billing, the dispensed amount (including any triggered by auto-toner-purge) is relevant. For feed forward controls designed to adapt to low or high area coverage at a developer, the amount of toner that leaves the developer in imaging, without taking auto-toner-purge into account, is relevant. Any one of these metrics may be accommodated by the system 10, using different look-up tables or functions.

In a continuous tone system, using a reduced-resolution image is optional and designed to reduce the time required to produce a result. In a binary system, the reduction in resolution accomplishes a conversion to continuous tone, and is therefore desirable. In the following discussion, a continuous tone image of a predetermined resolution is assumed.

Figure 2:
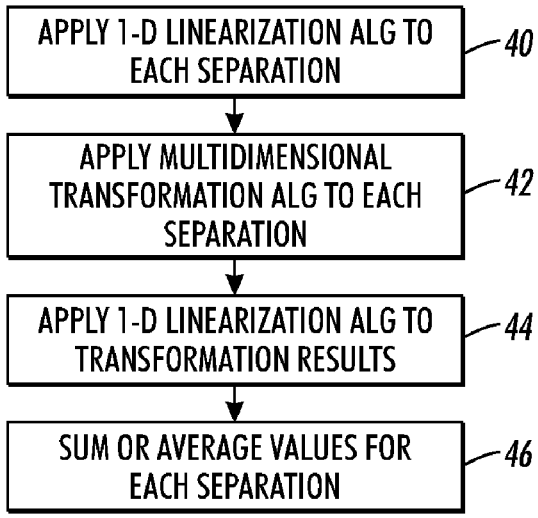
FIG. 2 illustrates a method of calculation toner consumption in a printer that employs multiple interacting color separations for print jobs.

FIG. 2 illustrates a method of calculation toner consumption in a printer that employs multiple interacting color separations for print jobs. Given a continuous tone image, at 40, a one dimensional linearization is applied to the image data, which maps from coverage requested to toner consumed when single separations are printed alone. This linearization is applied to every separation and every pixel. If, due to the nature of the half-tone dot and the printer response, the quantity of toner consumed is nearly linear in the coverage requested, this step may be omitted, as small non-linearities may be accommodated in subsequent steps.

At 42, a multidimensional transformation is applied, which maps or correlates toner consumed in a non-interacting separation system to toner consumed in an interacting separation system. For example, an interpolated LUT is employed with mappings from single separation consumptions to resultant consumption at the nodes. The LUT may be interpolated with multi-linear or simplex-based interpolation (e.g., generalizations of tetrahedral), or by higher order (e.g., spline) interpolation. In another example, a functional form based on single matrix multiplication is used, either for a linear mapping or a non-linear mapping based on low order powers of the input separation quantities and their combinations.

At 44, an additional one-dimensional linearization is optionally applied to the result of the multidimensional transformation. At 46, values produced at 44 are summed and/or averaged, and the results are output and/or stored to memory for review.

The purpose of the linearization at 40 is to describe the image information in a linear space for execution of the multi-dimensional transformation at 42, to simplify the transformation. By linearizing the input to the multidimensional mapping, a need for a high resolution lookup-table, or high order matrix, is mitigated, and inaccuracies caused by interpolation or a single matrix calculation are minimized or eliminated.

The multi-dimensional transformation at 42 accounts for inter-separation dependencies. For an image-on-image (IOI) system, this is desirable regardless of the final result: the amount of toner that leaves the developer housing depends both on the requested coverage level and on the coverages of any prior separations printed. A general transformation would allow the amount to depend also on the coverages of subsequent separations (which is typically unlikely to be physically true), but the values within the table or matrix would be such that no real such dependency exists. For a non-IOI system, if the amount of toner on the page is required, this step accounts for re-transfer, which depends on prior separations. Thus, the amount of toner that leaves the developer housing is represented by the output of the transformation at 42.

The optional linearization at 44 accounts for toner that does not get transferred to the page. This includes process control patches, auto-toner-purge toner, and any other toner that does not transfer and is removed from the photoreceptor during cleaning, which tends to be highly non-linear in the amount that leaves the developer housing, hence the one dimensional TRC. The linearizations at 40 and 44 are optional, and their value would depend on the system in which the method is employed.

Figure 3:
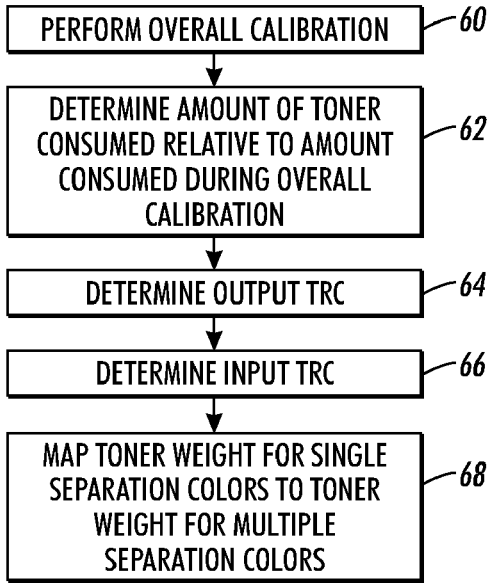
FIG. 3 illustrates a method of calibration a printer that employs multiple interacting color separations, in accordance with various aspects described herein.

FIG. 3 illustrates a method of calibrating a printer that employs multiple interacting color separations, in accordance with various aspects described herein. The calibration function would normally be performed once, (per model of printer) with its results stored in the lookup tables 30 and TRCs 34 (FIG. 1). An optional single parameter calibration may be offered to the customer to enable fine tuning, in implementations where the purpose is to provide cost estimating.

At 60, an overall printer calibration is performed, in which a known coverage is printed over a long series of prints: long enough to consume a significant fraction (e.g., 10%, 15%, etc.) of a toner cartridge or bottle. In this step, the total toner consumed is measured to give an overall conversion between coverage level and toner consumed per page. For many printers, this step is performed in advance, so that the consumables may be advertised as providing a given number of pages at a given coverage (e.g., 5%). However, an end-user may desire to perform this step to tune the printer to match the end-user's printing environment.

At 62, an amount of toner consumed is determined relative to an amount in the overall calibration computed at 60. For example, when the amount of toner on a 50% page is measured, it is compared to the amount on a nominal (e.g. 5%) page, to give a coverage adjustment factor. This coverage adjustment factor is then multiplied by the long run average for the nominal page. In this manner, only one coverage needs to be measured on a long run, while single pages with known coverage may be printed and weighed to obtain relative amounts for other coverage levels. If a customer wants to adjust the calculation to better match their environment, they may submit a realistic (e.g., long) job, which is estimated using the normal approach, and then the actual toner consumed is measured. If the job is long enough, it can be measured in units of toner bottles or cartridges. The ratio between the measured value and the estimated value is then multiplied by the stored nominal consumption value, to be used when estimating future jobs, in place of the original nominal consumption value.

At 64, the output TRC for the printer is determined. For instance, on a printer with a feature similar to auto-toner-purge, i.e. one that consumes a minimum amount of toner on the average page, regardless of the amount transferred to the page, the output TRC is computed using multiple long runs: one long run with low coverage, and one or more long runs with high enough coverage to consume more than the fixed minimum. A piecewise linear function may be fit, with a constant for the low coverage region, followed by a linear increase passing through the other two measured points, as shown in the graph 80 of FIG. 4.

Still referring to FIG. 3, the output TRC functions translate or map toner transferred to the page to toner consumed. For many systems it is adequate to find the output TRC using one separation and assume it is the same for the others. If there is reason to believe they are different, it may be tested by measuring those believed to be most different, and then performing a statistical test to determine whether those measurements are truly different beyond measurement uncertainty. If they are not distinct, they can be averaged.

At 66, the input TRC is determined. Again, this is a separation-independent process, however it is less likely to yield the same TRC for all separations, and thus they are best treated separately. Color patches are printed at each of a relatively large number of levels (30+) on a series of sheets, printing enough sheets to average out variability in the density of the paper itself. One of the patches has zero coverage so that the weight of the paper after fusing can be measured. One way of reducing the number of pages to measure while increasing the number of measurements, and hence the accuracy, is to print four levels each on a quarter of a sheet. When the area of each coverage level can be precisely measured and/or specified, it may be beneficial to divide the sheet into more than four segments. When each sheet has a different combination of levels, each level occurs on multiple sheets, and the total number of sheets significantly exceeds the number of levels, linear regression may be employed to find the weight of a page with a given coverage level from the weights of the combined patches.

A simple example follows: suppose nine levels are printed, and their mean weights are as given in the table below.

TABLE 1

| Level | Total weight |
|---|---|
| 0 | 4.0000 |
| 12.5 | 4.0693 |
| 25 | 4.1375 |
| 37.5 | 4.2035 |
| 50 | 4.2664 |
| 62.5 | 4.3251 |
| 75 | 4.3787 |
| 87.5 | 4.4264 |
| 100 | 4.4675 |

Now take combinations of them as shown below:

TABLE 2

36 pages, each with a unique combination of 4 coverage levels. Measurement noise is simulated as Gaussian, 0 mean 1 mg stdev, weights in grams.

| 0.00 | 12.5 | 25 | 37.5 | 50 | 62.5 | 75 | 87.5 | 100 | Meas. Wt. |
|---|---|---|---|---|---|---|---|---|---|
| 1 | 1 | 1 | 1 | 0 | 0 | 0 | 0 | 0 | 4.10245 |
| 1 | 1 | 1 | 0 | 1 | 0 | 0 | 0 | 0 | 4.11839 |
| 1 | 1 | 1 | 0 | 0 | 1 | 0 | 0 | 0 | 4.13278 |
| 1 | 0 | 1 | 0 | 1 | 1 | 0 | 0 | 0 | 4.18230 |
| 1 | 0 | 0 | 0 | 1 | 0 | 1 | 0 | 0 | 3.16119 |
| 1 | 0 | 1 | 0 | 1 | 0 | 1 | 0 | 0 | 4.19567 |
| 0 | 1 | 1 | 0 | 1 | 0 | 1 | 0 | 0 | 4.21299 |
| 0 | 0 | 1 | 0 | 1 | 1 | 1 | 0 | 0 | 4.27718 |
| 0 | 1 | 1 | 1 | 0 | 0 | 0 | 1 | 0 | 4.20912 |
| 1 | 0 | 1 | 0 | 1 | 0 | 0 | 1 | 0 | 4.20763 |
| 0 | 1 | 1 | 0 | 1 | 0 | 0 | 1 | 0 | 4.22499 |
| 0 | 1 | 1 | 0 | 0 | 1 | 0 | 1 | 0 | 4.23961 |
| 1 | 0 | 0 | 1 | 0 | 1 | 0 | 1 | 0 | 4.23872 |
| 0 | 1 | 0 | 1 | 0 | 1 | 0 | 1 | 0 | 4.25619 |
| 0 | 1 | 0 | 0 | 1 | 1 | 0 | 1 | 0 | 4.27188 |
| 0 | 0 | 0 | 1 | 1 | 1 | 0 | 1 | 0 | 4.30528 |
| 0 | 1 | 1 | 0 | 0 | 0 | 1 | 1 | 0 | 4.25297 |
| 1 | 0 | 0 | 1 | 0 | 0 | 1 | 1 | 0 | 4.25235 |
| 0 | 1 | 0 | 1 | 0 | 0 | 1 | 1 | 0 | 4.26933 |
| 0 | 0 | 0 | 0 | 1 | 1 | 1 | 1 | 0 | 4.34912 |
| 1 | 1 | 1 | 0 | 0 | 0 | 0 | 0 | 1 | 4.16861 |
| 1 | 0 | 1 | 0 | 0 | 1 | 0 | 0 | 1 | 4.23238 |
| 1 | 0 | 0 | 1 | 0 | 1 | 0 | 0 | 1 | 4.24915 |
| 0 | 1 | 0 | 1 | 0 | 1 | 0 | 0 | 1 | 4.26635 |
| 1 | 0 | 0 | 0 | 1 | 1 | 0 | 0 | 1 | 4.26475 |
| 1 | 0 | 1 | 0 | 0 | 0 | 1 | 0 | 1 | 4.24594 |
| 1 | 0 | 0 | 1 | 0 | 0 | 1 | 0 | 1 | 4.26243 |
| 0 | 1 | 0 | 1 | 0 | 0 | 1 | 0 | 1 | 4.27973 |
| 1 | 0 | 0 | 0 | 1 | 0 | 1 | 0 | 1 | 4.27834 |
| 0 | 0 | 1 | 0 | 1 | 0 | 1 | 0 | 1 | 4.31271 |
| 0 | 0 | 0 | 1 | 1 | 0 | 1 | 0 | 1 | 4.32903 |
| 0 | 0 | 0 | 1 | 0 | 1 | 1 | 0 | 1 | 4.34370 |
| 0 | 1 | 0 | 1 | 0 | 0 | 0 | 1 | 1 | 4.29167 |
| 0 | 1 | 0 | 0 | 1 | 0 | 0 | 1 | 1 | 4.30743 |
| 0 | 0 | 0 | 1 | 0 | 1 | 0 | 1 | 1 | 4.35555 |
| 0 | 0 | 0 | 0 | 0 | 1 | 1 | 1 | 1 | 4.39946 |

Using linear regression with the 0/1 values as inputs and the weights as outputs yields:

TABLE 3

The coefficients predict the weight of a quarter sheet to within two standard errors.

| | Coefficients | Standard Errort | Stat | P-value |
|---|---|---|---|---|
| Intercept | 0 | #N/A | #N/A | #N/A |
| 0 | 0.999982 | 0.000037 | 27248.45 | 0.000 |
| 12.5 | 1.017295 | 0.000040 | 25385.64 | 0.000 |
| 25 | 1.034385 | 0.000042 | 24567.30 | 0.000 |
| 37.5 | 1.050863 | 0.000041 | 25545.65 | 0.000 |
| 50 | 1.066652 | 0.000036 | 29945.52 | 0.000 |
| 62.5 | 1.081263 | 0.000034 | 31363.20 | 0.000 |
| 75 | 1.094692 | 0.000035 | 30903.56 | 0.000 |
| 87.5 | 1.106613 | 0.000038 | 29271.12 | 0.000 |
| 100 | 1.116897 | 0.000036 | 31341.73 | 0.000 |

It may be advantageous to print the reduced coverage levels multiple times, since the weight of the toner on such pages is small compared to that of the paper (at high coverage on light paper the toner weight can be in the range of 10-15% of the total; at low coverage this value drops proportionately).

Given the estimated weights of all coverage levels (paper and toner combined), the weight of 0 coverage (e.g., the tare weight of the paper) is subtracted from the weight of each of the other coverages, to obtain the toner weight for that coverage. This series of toner weights may be fit to a curve, such as a polynomial, a spline function, or a model based function derived from the nature of the halftone dot, or simply entered into a table which is linearly interpolated to provide a mapping from requested coverage to toner weight on paper.

At this point, two mappings have been derived: the input TRC that maps requested coverage to toner weight on paper; and the output TRC that maps toner weight on paper to toner consumed (which may be in units of weight or already converted to cost). The remaining mapping required handles interactions between separations.

At 68, toner weight on paper in single separation colors is mapped to toner weight on paper for multiple separation colors. To obtain this mapping, another series of prints is made, using the same scheme as for single separations to produce input for linear regression. The input levels can be specified in coverage, but then converted to single separation weights. The outputs are the weights of the prints. For a four color (e.g., CMYK) printer, measured at three levels per separation, all combinations gives 81 weights to measure. Nine of these are already known, leaving 72 to be measured, and the measurement need only be performed once. If it is known that the interactions are well modeled as linear, only 16 weights are needed, of which five are already known. If an empirical or physical model of inter-separation interactions is known, fewer measurements might be made in order to derive the parameters of such a model. For a more-than-four color (e.g. CMYKOV) printer, the number of measurements increases, however similar techniques can be used to reduce the number to a manageable value. Since certain combinations are unlikely to be used in practice (such as all six colors printed together), these may be estimated without measurement. It will be appreciated that the various embodiments as described and claimed herein are applicable to printing systems that employ more than four color separations, and that reference herein to a "plurality" of interacting color separations includes, in some embodiments, more than four color separations, such as in a CMYKOV printing system or the like.

In another embodiment, a monetary cost is generated based on the amount of toner consumed for each color separation. For instance, after the interacting separations have been accounted for, the final TRC, rather than mapping to quantity of toner dispensed, could map to cost of the same quantity of toner. Alternatively, the quantity can be multiplied by factors that reflect the cost of toner at a given time. The cost of each color of toner employed in the separation may be presented separately or the costs of all colors in the separation may be added together and a total cost for the separation presented to the user.

Figure 4:
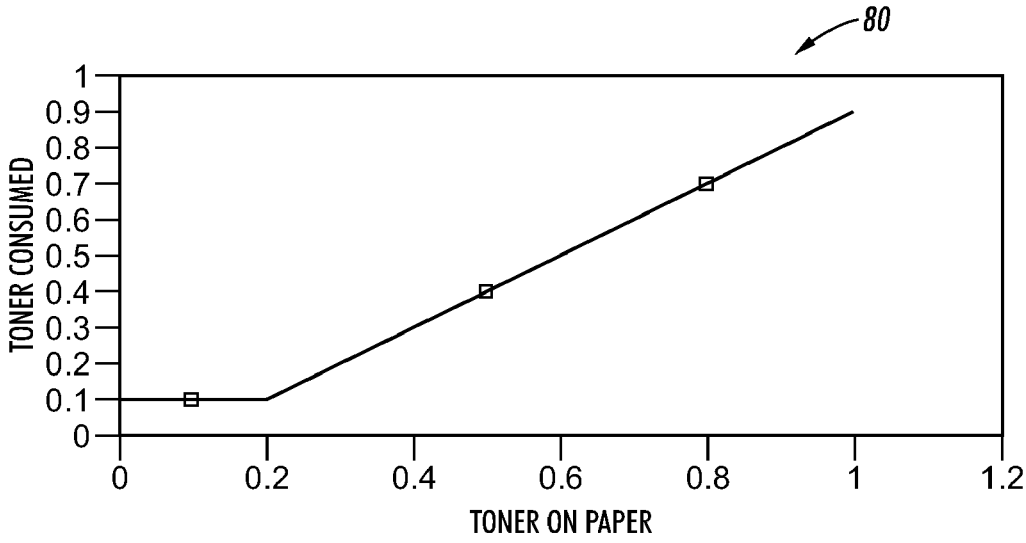
FIG. 4 illustrates a graph showing toner transferred versus toner consumed, per page, in a printing engine.

FIG. 4 illustrates a graph 80 showing toner transferred versus toner consumed, per page, on a printer such as a XEROX iGEN™ printing engine. On a printer without a minimum consumption constraint, two points (one made by running blank sheets, and one by running high area coverage) are sufficient to obtain a straight line which gives the nominal consumption as a function of transferred toner. This accounts for any process control patches, and toner otherwise lost to the sump, and not transferred to paper.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A method of calculating toner consumption by a printer, comprising:

receiving image data describing a plurality of interacting color separations in an electronic image;

executing a multi-dimensional transformation on the image data to correlate an amount of toner to be consumed in a non-interacting separation to an amount of toner to be consumed in an interacting separation, for each of the interacting color separations; and outputting a toner consumption value for each of the plurality of interacting color separations, the toner consumption value correlating to an actual quantity of toner to be transferred to an output medium corresponding to a rendering of the received image data thereon.

2. The method of claim 1, further comprising performing a first one-dimensional linearization to linearize the image data before performing the multi-dimensional transformation, and executing the multi-dimensional transformation on the linearized image data.

3. The method of claim 2, further comprising summing the output toner consumption values for all interacting color separations.

4. The method of claim 2, further comprising generating an average of the output toner consumption values for all interacting color separations.

5. The method of claim 2, further comprising performing a second one-dimensional linearization on transformed image data after performing the multi-dimensional transformation on the linearized image data, wherein an output of the second one-dimensional linearization indicates an amount of consumed toner that is not transferred to the output medium.

6. The method of claim 5, further comprising summing the output toner consumption values for all interacting color separations.

7. The method of claim 5, further comprising generating an average of the output toner consumption values for all interacting color separations.

8. The method of claim 1, further comprising performing a one-dimensional linearization on transformed image data after performing the multi-dimensional transformation on the image data, wherein an output of the second one-dimensional linearization indicates an amount of consumed toner that is not transferred to the output medium.

9. The method of claim 8, further comprising summing the output toner consumption values for all interacting color separations.

10. The method of claim 8, further comprising generating an average of the output toner consumption values for all interacting color separations.

11. The method of claim 1, further comprising reducing the resolution of the received image data to generate reduced-resolution continuous tone image data.

12. The method of claim 1, wherein the multi-dimensional transform has a number of dimensions equal to the number of interacting color separations.

13. The method of claim 1, wherein the plurality of interacting color separations includes one or more of a cyan (C) color separation, a magenta (M) color separation, a yellow (Y) color separation, and a key (K) color separation.

14. The method of claim 1, further comprising performing a table lookup to compute a monetary cost for the calculated toner value for each interacting color separation.

15. A toner consumption calculation system for a printer, comprising:

a memory that stores computer-executable instructions for:

performing a multi-dimensional transformation on the image data to correlate an amount of toner to be consumed in a non-interacting separation to an amount of toner to be consumed in an interacting separation, for each of the interacting color separations; and outputting a toner consumption value for each of the plurality of interacting color separations, the toner consumption value correlating to an actual quantity of toner to be transferred to an output medium corresponding to a rendering of the received image data thereon; and a processor that executes the instructions;

wherein the image data describes a plurality of interacting color separations in an electronic image.

16. The system of claim 15, wherein the memory stores, and the processor executes, computer-executable instructions for performing a one-dimensional linearization to linearize the image data before performing the multi-dimensional transformation, and performing the multi-dimensional transformation on the linearized image data.

17. The system of claim 16, wherein the memory stores, and the processor executes, computer-executable instructions for performing a one-dimensional linearization on transformed image data after performing the multi-dimensional transformation on the linearized image data, wherein an output of the second one-dimensional linearization indicates an amount of consumed toner that is not transferred to the output medium.

18. The system of claim 15, wherein the memory stores, and the processor executes, computer-executable instructions for at least one of summing the output toner consumption values for all interacting color separations, generating an average of the output toner consumption values for each interacting color separation, and reporting toner consumption values for each interacting color separation.

19. The system of claim 15, wherein the memory stores, and the processor executes, computer-executable instructions for reducing the resolution of the received image data, to generate reduced-resolution continuous tone image data.

20. The system of claim 15, wherein the multi-dimensional transform has a number of dimensions equal to the number of interacting color separations, and wherein the plurality of interacting color separations includes one or more of a cyan (C) color separation, a magenta (M) color separation, a yellow (Y) color separation, and a key (K) color separation.

21. An apparatus for calculating toner consumption in a printer, comprising:

means for receiving image data describing a plurality interacting color separations in an electronic image;

means for reducing the resolution of the received image data to generate continuous tone image data;

means for performing a first one-dimensional linearization to linearize the continuous tone image data;

means for performing a multi-dimensional transformation on the linearized image data using a lookup table to correlate an amount of toner consumed in a non-interacting separation to an amount of toner consumed in an interacting separation, for each of the interacting color separations;

means for performing a second one-dimensional linearization on transformed image data after performing the multi-dimensional transformation;

means for outputting an average toner consumption value for the plurality of interacting color separations, the toner consumption value correlating to an actual quantity of toner to be transferred to an output medium corresponding to a rendering of the received image data thereon;

wherein the multi-dimensional transform has a number of dimensions equal to the number of interacting color separations; and wherein the plurality of interacting color separations includes one or more of a cyan (C) color separation, a magenta (M) color separation, a yellow (Y) color separation, and a key (K) color separation.

* * * * *